US007089596B2

(12) United States Patent
Leflet et al.

(10) Patent No.: US 7,089,596 B2
(45) Date of Patent: Aug. 15, 2006

(54) BARREL RACING RODEO PANT SYSTEMS

(76) Inventors: Lloyd Leflet, P.O. Box 708, Wellington, CO (US) 80549; Leslie Leflet, P.O. Box 708, Wellington, CO (US) 80549

( * ) Notice: Subject to any disclaimer, the term of this patent is extended or adjusted under 35 U.S.C. 154(b) by 220 days.

(21) Appl. No.: 10/218,045

(22) Filed: Aug. 12, 2002

(65) Prior Publication Data

US 2003/0150042 A1 Aug. 14, 2003

Related U.S. Application Data

(63) Continuation-in-part of application No. 29/155,662, filed on Feb. 12, 2002, now Pat. No. Des. 467,705.

(51) Int. Cl.
*A41D 13/06* (2006.01)

(52) U.S. Cl. ..... 2/23

(58) Field of Classification Search ..... 2/227, 2/23, 24, 69, 114, 214, 247, 79, 83, 238, 228, 2/241, 242, 44, 268, 22, 267, 465, 455, 250, 2/252, 258, 260, 260.1, 92; 602/23, 26; 119/850, 119/856

See application file for complete search history.

(56) References Cited

U.S. PATENT DOCUMENTS

| | | | | | |
|---|---|---|---|---|---|
| 3,670,339 | A | * | 6/1972 | Cooper et al. | 2/22 |
| 3,787,892 | A | | 1/1974 | Quinn | 2/2 |
| D242,663 | S | | 12/1976 | Tidwell, Jr. | D2/28 |
| 4,091,466 | A | | 5/1978 | Kearn | 2/23 |
| 4,128,902 | A | | 12/1978 | Siebert | 2/2 |
| 4,164,044 | A | | 8/1979 | Holmes | 2/237 |
| D261,324 | S | | 10/1981 | Catron | D2/28 |
| D267,674 | S | | 1/1983 | Livernois | D2/28 |
| 4,455,686 | A | * | 6/1984 | Zide | 2/23 |
| 4,479,269 | A | | 10/1984 | Balliet | 2/23 |
| 4,561,124 | A | | 12/1985 | Thompson | 2/23 |
| 4,613,991 | A | | 9/1986 | Grover | 2/23 |
| D289,221 | S | | 4/1987 | Maejima | D2/28 |
| D289,222 | S | | 4/1987 | Maejima | D2/28 |
| 4,700,407 | A | | 10/1987 | Mattila | 2/23 |
| 4,737,994 | A | | 4/1988 | Galton | 2/2 |
| 4,805,243 | A | | 2/1989 | Gibbens et al. | 2/228 |
| 4,894,867 | A | | 1/1990 | Ceravolo et al. | 2/238 |
| 4,920,577 | A | | 5/1990 | Scharf | 2/24 |
| 5,105,473 | A | * | 4/1992 | Valtakari | 2/461 |
| 5,161,257 | A | * | 11/1992 | Arensdorf et al. | 2/465 |
| D349,388 | S | | 8/1994 | Sloan | D2/860 |
| 5,365,610 | A | | 11/1994 | Lubahn et al. | 2/23 |
| D353,254 | S | | 12/1994 | Welch | D2/743 |

(Continued)

*Primary Examiner*—Tejash Patel
(74) *Attorney, Agent, or Firm*—Santangelo Law Offices, P.C.

(57) ABSTRACT

Barrel racing rodeo pant systems are provided with pockets which retain a protector element for the protection of the barrel racer. The pant system may comprise a pair of pants having a pocket secured to at least one leg which retains a protector element. Pant systems may also comprise a pocket secured to at least one pant leg and configured to retain a protector element at a location corresponding to the anatomy of a human leg between the ankle and the knee. Further, the pocket is elastically tensionable to allow the protector element to move in response to elastic tension generated in the pocket. Elastically tensionable material is provided to form the pocket in some embodiments. The protector element may also locate to a position when the elastically tensionable material conforms to a portion of human leg. The protector element in some embodiments is removably insertable in the pocket.

21 Claims, 13 Drawing Sheets

U.S. PATENT DOCUMENTS

| | | | | |
|---|---|---|---|---|
| D373,892 | S | 9/1996 | Landwehr | D2/747 |
| D381,490 | S | 7/1997 | Torres | D2/742 |
| 5,649,328 | A | 7/1997 | Martin | 2/238 |
| 5,732,412 | A | 3/1998 | Holden | 2/23 |
| D393,141 | S | 4/1998 | Glycenfer | D2/742 |
| D395,939 | S | 7/1998 | DeFino | D2/742 |
| 5,845,333 | A | 12/1998 | Crampton | 2/24 |
| 5,896,580 | A | 4/1999 | Aldrich et al. | 2/24 |
| D411,907 | S | 7/1999 | Kling | D2/742 |
| 5,920,902 | A | 7/1999 | Crampton | 2/24 |
| 5,920,915 | A | 7/1999 | Bainbridge et al. | 2/456 |
| D415,335 | S | 10/1999 | Castiglione | D2/861 |
| 6,014,771 | A | 1/2000 | Kirven | 2/23 |
| D420,492 | S | 2/2000 | Tannenbaum | D2/860 |
| 6,032,300 | A | 3/2000 | Bainbridge et al. | 2/456 |
| 6,055,676 | A | 5/2000 | Bainbridge et al. | 2/456 |
| 6,327,713 | B1 | 12/2001 | Gomez | 2/227 |

* cited by examiner

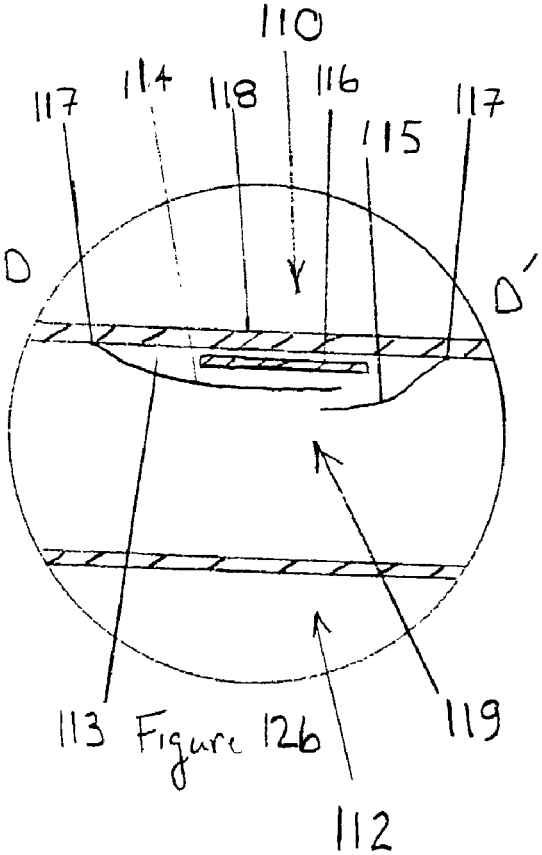
Figure 12b
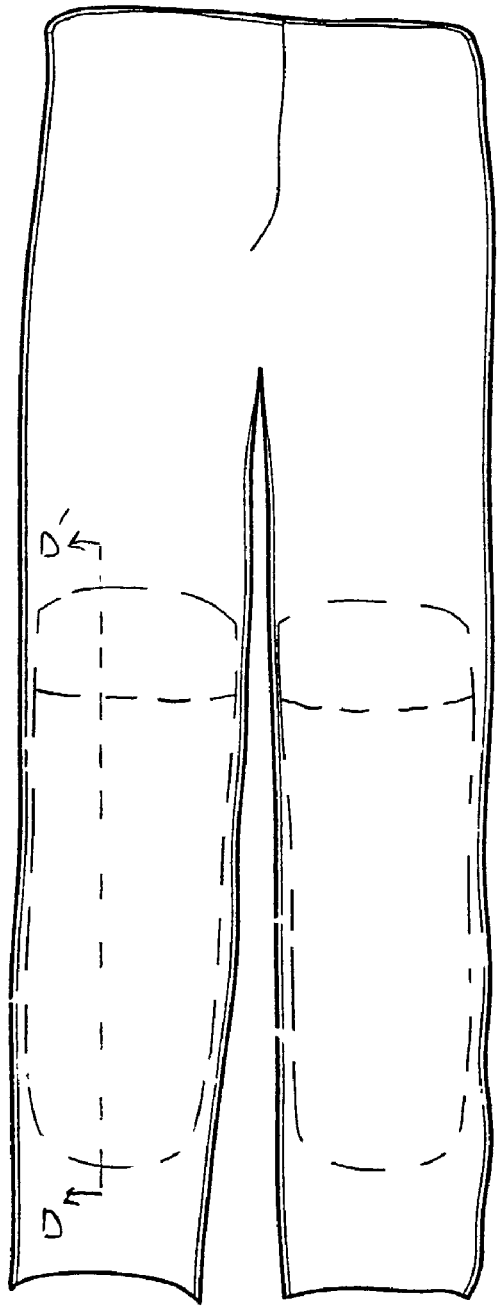
Figure 12a
FIG. 12

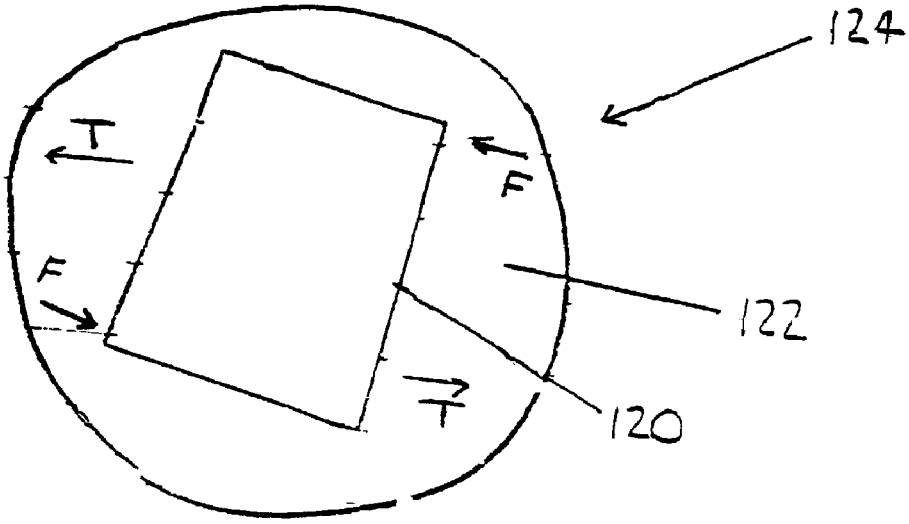
Figure 13a
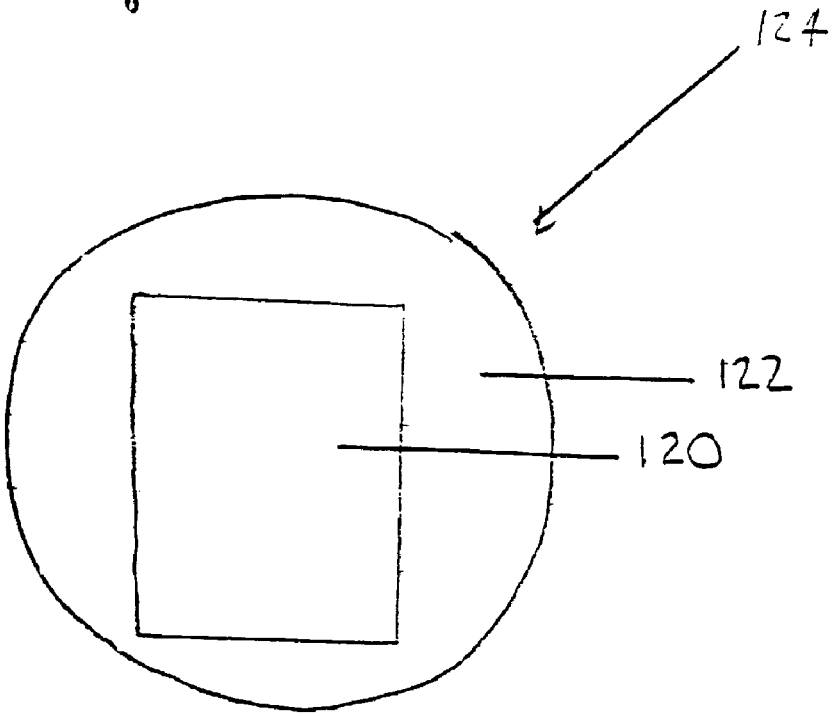
Figure 13b
FIG. 13

BARREL RACING RODEO PANT SYSTEMS

This application is a continuation-in-part of U.S. patent application Ser. No. 29/155,662, filed Feb. 12, 2002, now U.S. Pat. No. Des. 467,705, hereby incorporated by reference.

I. TECHNICAL FIELD

Pants providing protection from impact forces for a portion of the anatomy of the human leg. Specifically, barrel racer rodeo pants configured to retain a protector element to protect the shin of the human leg during barrel racing competition.

II. BACKGROUND

In barrel racing competition, contestants compete for the fastest time in running a triangular, cloverleaf pattern around three barrels. The horse and rider are allowed a running start and time begins and ends upon crossing a visible starting line. Touching a barrel is permitted, but a five-second penalty is assessed for knocking over a barrel.

The pattern can be started either from the left or right, and contestants who go off the prescribed course are disqualified. The rider can choose to start on either of the front two barrels. A pattern that starts with the right turn around the right hand barrel must be followed by two left turns. A rider who chooses to go left first must make two right hand turns for the second and third barrel. Either start produces the desired cloverleaf pattern. Racing times are measured in the hundredths of seconds. Clearly, knocking over a barrel is disastrous in a race that may take as little as 14 seconds from start to finish.

Success in barrel racing depends on the skills and training of both a rider and a horse, as well as on the quality of the communication between the rider and the horse. The rider must rein the horse to combine running speed with tight turns around each barrel to minimize the distance the horse runs between the start and the finish of the clover leaf pattern.

Because the distance the horse runs to complete the cloverleaf pattern is a significant factor in obtaining the fastest time, the rider urges the horse to come as close to each barrel as possible without knocking the barrel over. As a result, it is not uncommon for the leg of the rider or the body of the horse to contact one or more of the barrels in completing the cloverleaf pattern.

The impact of the human leg with the barrel can result in injury to the rider. The injury can be exacerbated because the rider's leg may be held against the body of the horse. As such, the total mass contacting the barrel can be the combined mass of the rider's leg and a portion of the mass of the horse. This combined mass having a velocity equal to the speed at which the horse is running at the time of contact with the barrel can generate a large amount of impact force incident upon the rider's leg.

As such, barrel racers may desire to wear leg protection devices, such as shin guards, during barrel racing practice, training, or competition to prevent or minimize injury from contact or impact with the barrels. While the use of a conventional shin guard(s) that strap to the rider's leg(s) directly or over the clothing worn during barrel racing may prevent or minimize leg injury, significant problems still remain with regard to protecting the human leg whether specifically during barrel racing, or participating in other work or recreational activities.

A significant problem with conventional protection devices can be that they are held in place directly against the wearer's leg. One aspect of this problem can be that when the protection device is worn under clothing it becomes difficult or impossible to remove the protection device without first removing the clothing. The clothing may also bunch, catch, snag, or otherwise interact excessively with the protection device as the clothing moves over the protection device in response to the movement of the wearer. A second aspect of this problem can be that when the protection device is worn over clothing, the portion of the clothing held between the protection device and the leg cannot move in response to the motion of the wearer. This may limit the range of motion of the wearer and impede the wearer's performance. A third aspect of this problem may be that the protection device has little or no movement in response to compression or impact forces. If for example, the protection device becomes caught or held, forces (which can be considerable when a horse is running) are transmitted substantially in their entirety to the wearer's leg.

Significant problems may also exist with respect to conventional protective garments in which a protector device(s) are made a part of, held by, or are inserted into the garment. One aspect of this problem may be that garments including a protection device are not configured to account for the wide range of activities or movement of a wearer. This may be particularly true of the activities that accompany the transportation, handling, mounting, or riding of a horse, and specifically, there may be no protective garment that specifically addresses the wide range of activities or movements required of barrel racers or barrel racing. Because the range of activities of a barrel racer involve movement of the leg from being held substantially straight (when standing, for example) to be being bent close to the chest area (when mounting a horse, for example) along with intermediate movements during riding (which can involve intermittent standing, sitting, crouching, or rocking movements), the garment must be allowed considerable range of movement while the protector element must (during the barrel racing event) have a position corresponding to the portion of the wearer's anatomy to be protected. Again, specifically with respect to barrel racing which is punctuated by brief periods of competition and long waiting periods, but also with respect to other types of activities that require protection for only short periods of time and have long intervals in between, conventional protective garments may not allow the protective device to move to a resting or inactive location within the garment that may be more comfortable or less cumbersome to the wearer, or affords the garment a more attractive appearance or traditional look or feel during periods of non-competition or during periods when protection is not desired.

Another significant problem with conventional protective garments may be the lack of a resilient elastically tensionable material to transfer the forces generated by movement of the wearer to the protective device retained by the garment. Once aspect of this problem can be that the garment is substantially inelastic allowing the entirety of forces generated by movement of the garment against the protective device to be transferred to the wearers anatomy. If the location of the protective device does not allow precise correspondence of configuration to the adjacent anatomy of the wearer, then the wearer can experience considerable discomfort. This problem can be exacerbated when a considerable range of garment motion, as described above, is required for an activity. Another aspect of this problem can be that the forces generated by movement of the garment are not transferred to the protective device so that the protective device can move within the garment to a location or position corresponding to the portion of the anatomy the protector device was configured to protect.

Another significant problem with conventional protective garments may be that the elastic materials used cannot be repeatedly tensioned and relaxed and still retain sufficient resiliency to allow the protector device to be repeatedly positioned properly with respect to the portion of the anatomy the protector device was configured to protect.

The instant invention addresses each of the above-mentioned problems with conventional protection devices and methods of protection and provides numerous embodiments of a garment protection system, including but not limited to, embodiments of a garment protection system specifically configured for a barrel racing rodeo pants system, that provides protection of human leg(s) or portions thereof.

III. SUMMARY OF THE INVENTION

Accordingly, the broad object of the invention can be to provide a protective pants system that can be worn while participating in a variety of activities. While the description and drawings included in this application provide specific examples of the invention in the context of barrel racing rodeo pants, these specific examples and drawings are not meant to limit the invention solely to providing barrel racing rodeo pants but are intended to be illustrative of the generic aspects of the invention which can be incorporated into a numerous and wide variety of protective garments.

Another broad object of the invention can be to provide a protective pants system that avoids or substantially reduces restraint of motion in the pants to allow the wearer to participate in, or have an enhanced performance in, activities in which the leg travels through a varied or wide range of motion(s).

Another broad object of the invention can be to provide a protective pants system that allows the protector element to travel or be adjusted within the garment such that the location of the protector element can be different with respect to different activities in which the wearer is engaged. Specifically with respect to rodeo sports, as an example, the invention can provide sufficient travel within the protective pants system so that the protector element can locate or be adjusted to accommodate activities ranging from standing or walking, to handling or training rodeo livestock, as well as mounting, dismounting, or riding rodeo livestock such bulls or horses, as but two examples.

Another broad object of the invention can be to provide a protective pants system having a configuration and construction that translates forces of engagement between the pant material and the protector element into travel of the protector element between a resting location and a location corresponding to the anatomy of the human leg the protector element is configured to protect.

Another significant object of the invention can be to provide resiliently elastic materials and protective pant configurations, separately or in combination, suitable for inducing travel in a protector element so that it has a location corresponding or adjacent to the portion of the anatomy of the human leg the protector element was configured to protect. An aspect of this object can be to provide resiliently elastic materials that maintain resiliency when repeatedly tensioned against a protector element, such as a shin guard.

Naturally, further objects of the invention are disclosed throughout other areas of the specification and drawings.

IV. BRIEF DESCRIPTION OF THE DRAWINGS

FIG. 9*a* is a front view of the embodiment and FIG. 9*b* is a cross section at A–A'.

FIG. 11*a* is a front view of the embodiment and FIG. 11*b* is a cross section at C–C'.

FIG. 12 are a third embodiment of the present invention of a pair of pants retaining a protector element and the protector element being removably insertable. FIG. 12*a* is a front view of the embodiment and FIG. 12*b* is a cross section at D–D'.

FIG. 13 are a graphical representation of an interaction between a pocket and material of the pocket and a protector element consistent with the present invention.

V. DETAILED DESCRIPTION OF PREFERRED EMBODIMENTS

The protective pants system invention can involve one or more materials, elements, devices, apparatuses, steps, methods, or processes to protect the anatomy of the human leg, including but not limited to protective pants, methods of manufacturing protective pants, methods of protecting the anatomy of the human leg, methods of wearing protective pants, or the like. Preferred embodiments of the protective pants system may have applications with respect to handling, training, or riding of animals in general, and particularly with respect to performing rodeo events or riding horses or bulls, with certain embodiments of the protective pants system specifically configured to be worn by barrel racers.

Pants

Figure 1:
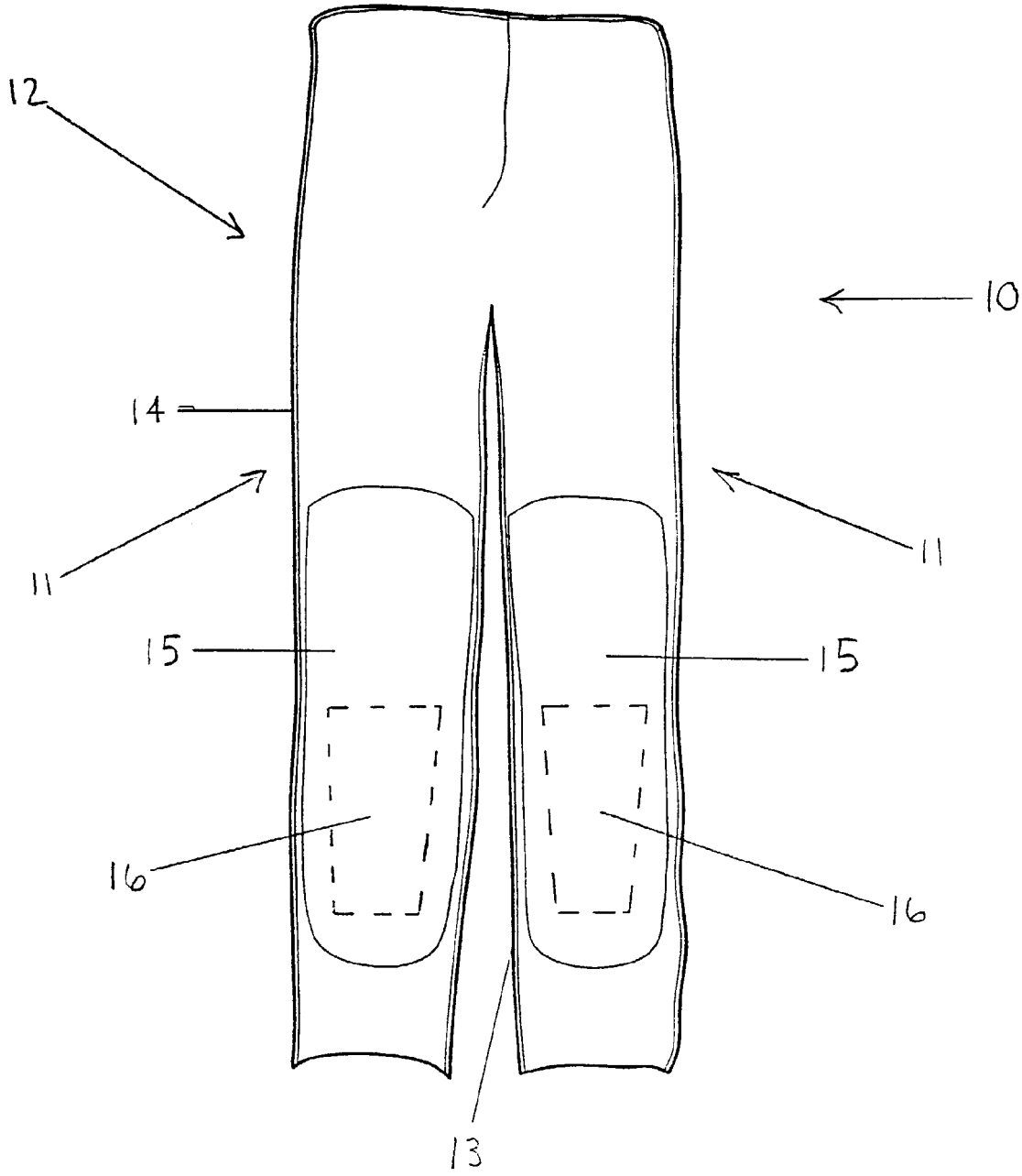
FIG. 1 is a front view of one embodiment of the present invention embodied as a pair of pants.

Now referring primarily to FIG. 1, the invention can include a pair of pants (10) configured for general activity and wear which may further include elements to allow the pair of pant to be suitable for rodeo or animal riding, generally, or to be suitable for specific activities such as barrel racing, not inconsistent with aspects of the invention described below.

Accordingly, a pair of pants (10) can have at least one pant leg (11). Each pant leg configured to accommodate the proportions of the anatomy of the human leg. Pairs of pants consistent with the present invention may alternatively comprise one pant leg, or a portion of one or two pant legs, to accommodate, for example, physically impaired individuals. The pair of pants have a front portion (12) and a back portion (not shown in FIG. 1). The front and back portions, in some embodiments, can be joined at an inner seam (13) and an outer seam (14). Seams of the present invention can terminally join pieces of material to provide the general configuration of the pair of legs and torso portions of the pants. The seams can comprise any manner of terminally joining the pieces of material not inconsistent with the invention as described. The seams may comprise, in various embodiments, one or more stitches, threads, snaps, hooks, buttons, zippers, straps, lace, string, bungee, tie, adhesive-type material, heat sealed, hook and loop materials, such as Velcro®, or other like elements.

Further, the pair of pants can have one or a plurality of pockets (15). Each pocket (15) can be configured relative to a portion of a pant leg (11), or may be configured relative to a torso portion or other portion of the pants, and in some preferred embodiments, a pocket is secured to at least one pant leg. Each pocket may also be variously configured to a front portion or a back portion of the pair of pants, consistent with each of the other features of the present invention. In some embodiments, the pocket (15) may be secured at a location adjacent to or corresponding to the anatomy of a human, and in preferred embodiments, each pocket may be secured to a location corresponding to the anatomy of a human leg between the ankle and knee. Alternatively, each pocket may be secured to other locations corresponding to the human anatomy and portions thereof, such as portions or the entire region of the hip, thigh, buttock, coccyx, groin, or ankle. One or a plurality of pockets (15) may be secured to one or a plurality of such portions or regions corresponding to the human anatomy. Pocket (15) may be fixedly or removably secured, and may be secured with one or a plurality of elements, such as one or a plurality of seams. The pocket may be fixedly or removably secured with one or more threads, snaps, hooks, buttons, zippers, straps, lace, string, bungee, tie, adhesive-type material, hook and loop materials, such as Velcro®, or other like elements. Pocket (15) can also be configured to retain a protector element (16), as further described below.

Each of the embodiments described may comprise one or more pockets (15) within the portion of pants or outside the portion of pants, and in some embodiments, contiguous with the portion of pants. Therefore, each of the pocket(s) shown in the figures and otherwise disclosed in this description can be provided within or outside the portion of pants, such as the pant leg, and may be contiguous with the portion of pants, such as the pant leg. Further, the pockets may be configured to maintain a desired configuration, and in some embodiments, to resist pucking or other undesired deformation of the pocket material.

Figure 2:
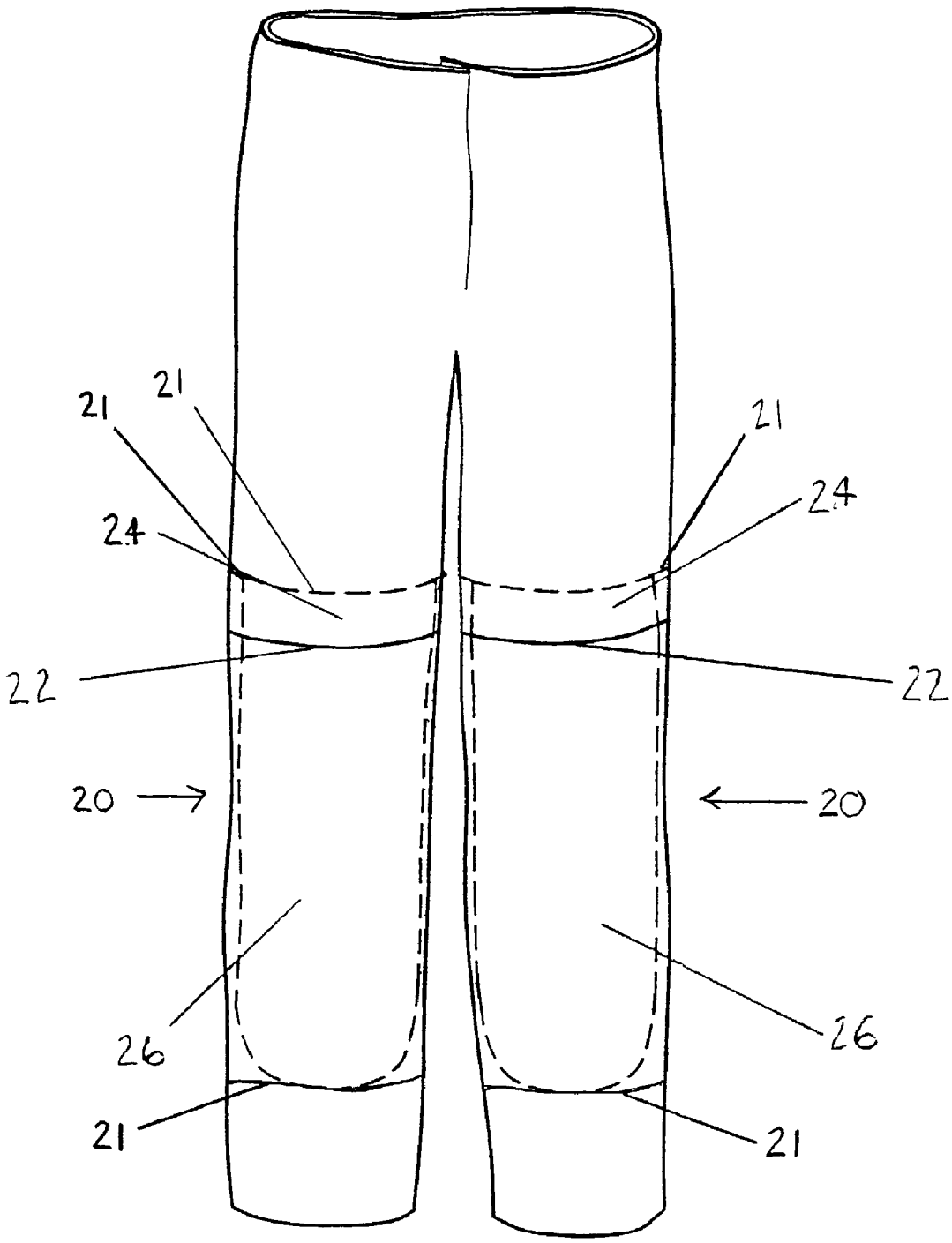
FIG. 2 is a front view of an embodiment of the present invention embodied as a pair of pants with accessible pockets.

Now referring primarily to FIG. 2, an access (22) can be provided to each pocket (20). The access (22), in some embodiments, may further comprise a closure. The access (22) can provide ingress and egress from outside of the pants to inside of the pants, such as access from the outside to the inside of the pant leg. The closure may be a discrete element or elements, such as one or more threads, snaps, hooks, buttons, zippers, straps, lace, string, bungee, tie, adhesive-type material, or other like elements. The closure may also consist of hook and loop materials, such as Velcro®. The closure may also be provided by the configuration of materials comprising each pocket, for example two pieces of material can be positioned to overlap.

Figure 3:
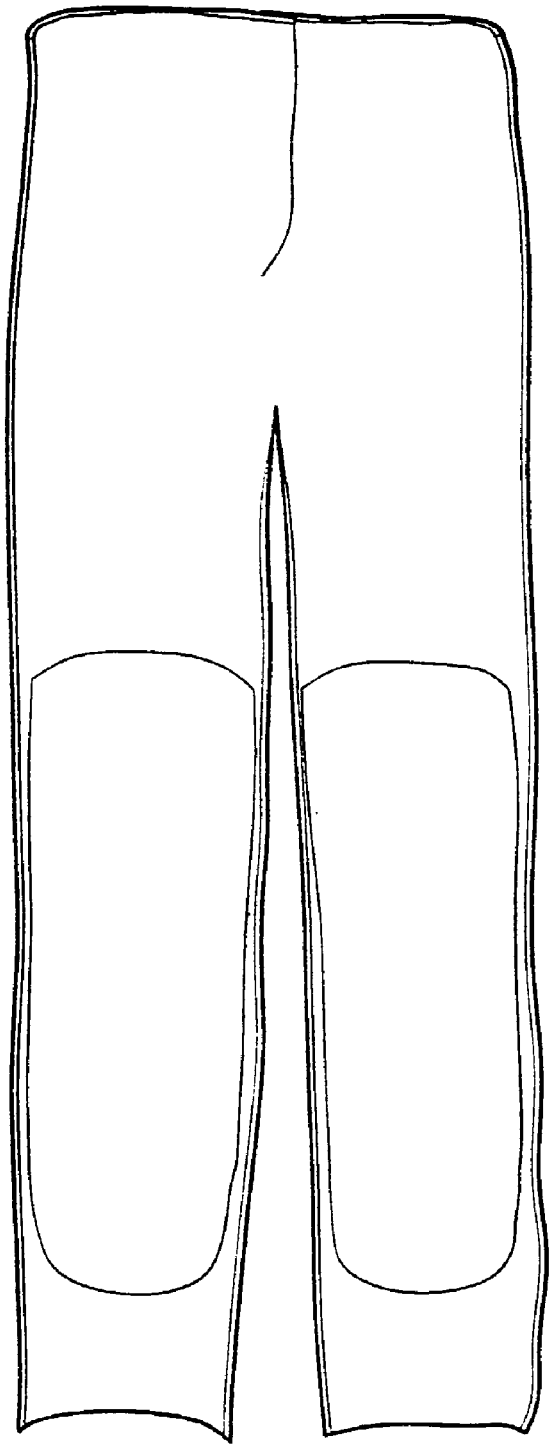
FIG. 3 is a front view of an embodiment of the present invention embodied as a pair of pants without access features.

Now referring primarily to FIG. 3, some embodiments of the invention may provide a pocket without an access. Although FIG. 3 depicts the pockets as an outer feature of the pant leg, pockets lacking an access may also be provided as an inner feature of the pant leg, consistent with the features of the present invention.

Figure 4:
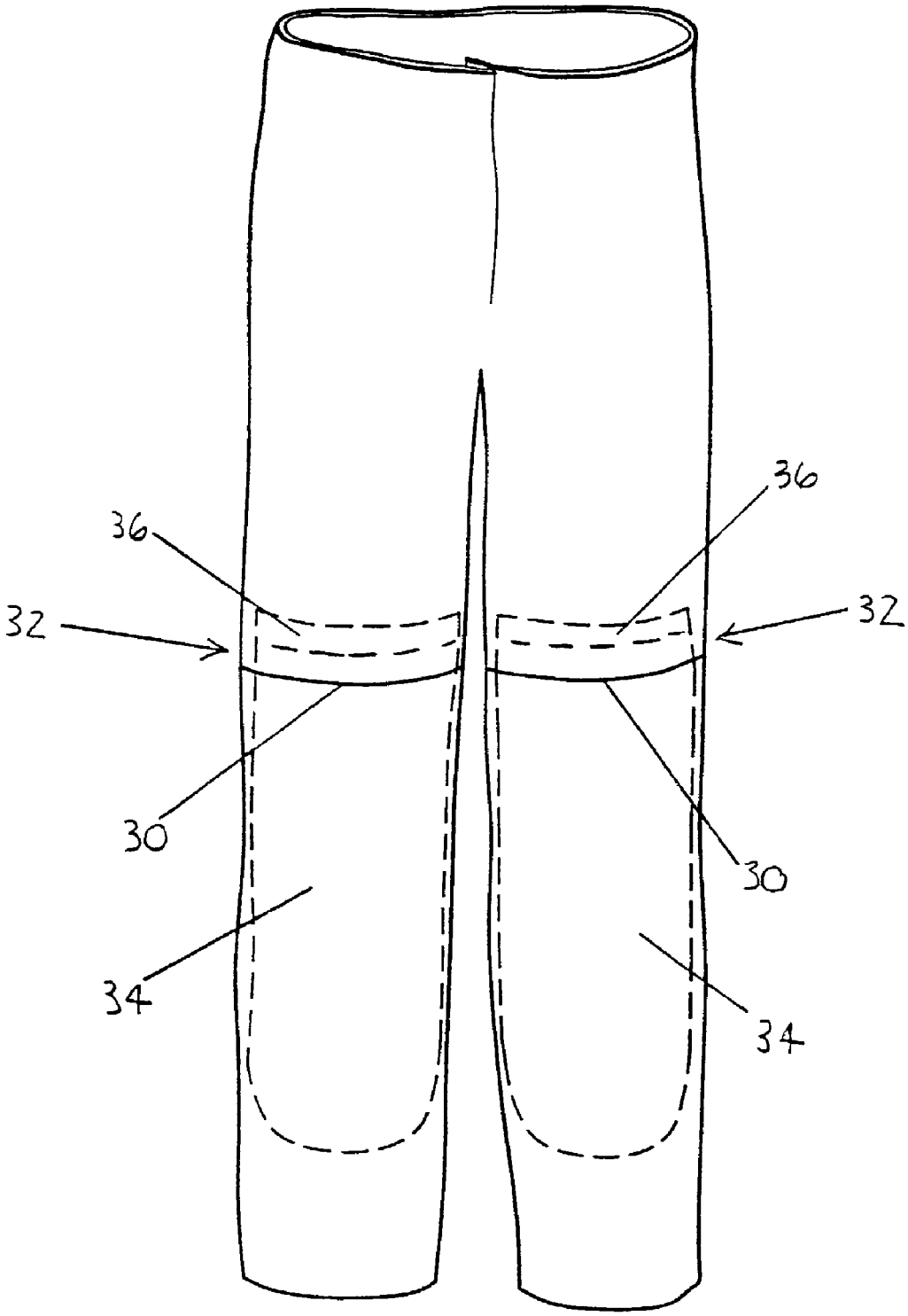
FIG. 4 is a front view of a second embodiment of the present invention of a pair of pants with accessible pockets.

Now referring primarily to FIG. 4, certain embodiments of the invention can include a first piece of material (34) and a second piece of material (36). The first and second pieces of material may be configured to provide access (30). In one preferred embodiment, the first and second pieces of material overlap to provide an access from the outside of the pant leg to the inside of the pant leg. Other configurations of the first and second pieces of material may also provide an access, can provide first and second pieces of material secured to an inner portion of the pants, and/or may provide an access from the inside of the pant leg to the outside of the pant leg, as further described below.

Figure 5:
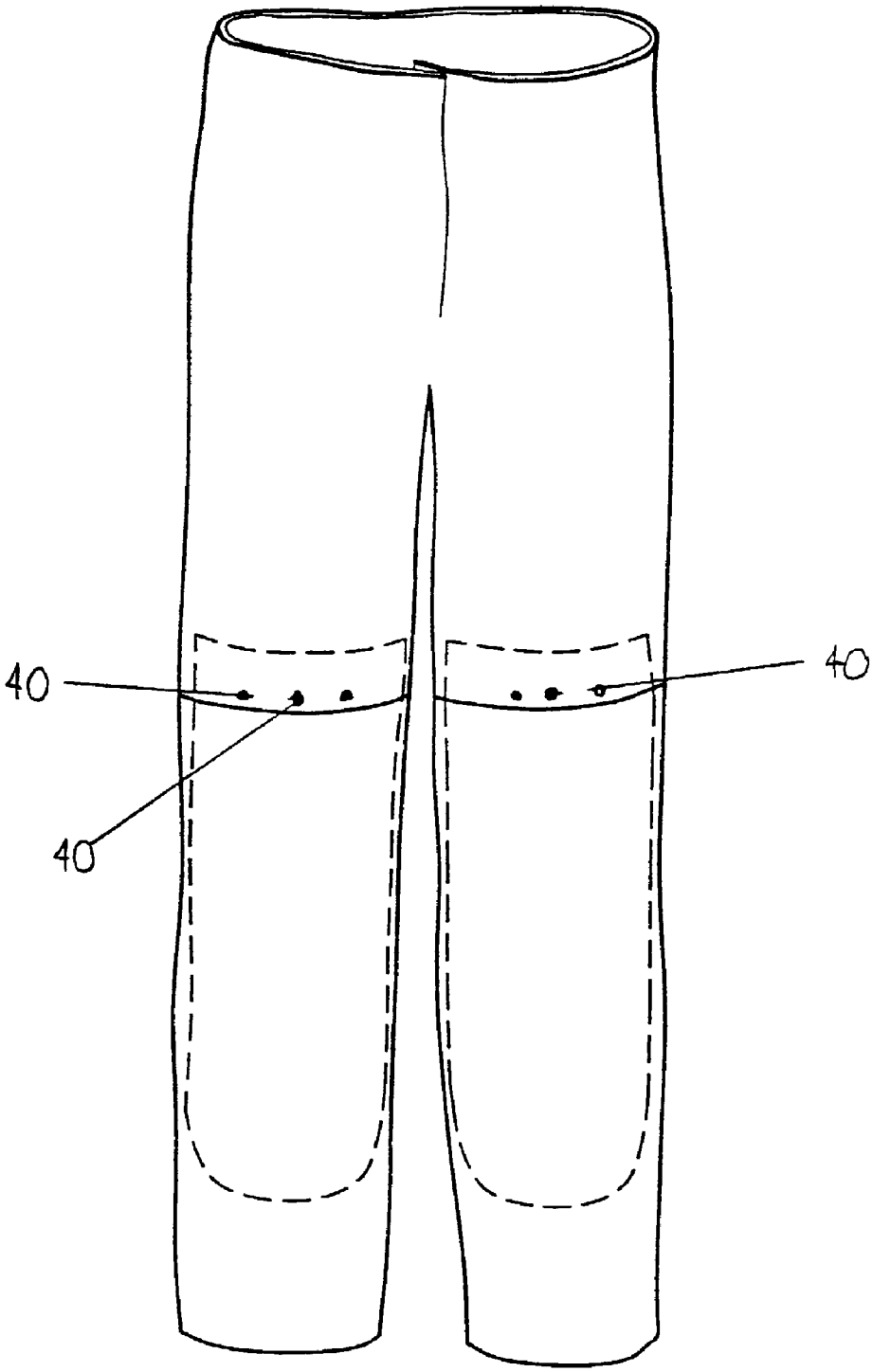
FIG. 5 is a front view of a third embodiment of the present invention of a pair of pants with accessible pockets.
Figure 6:
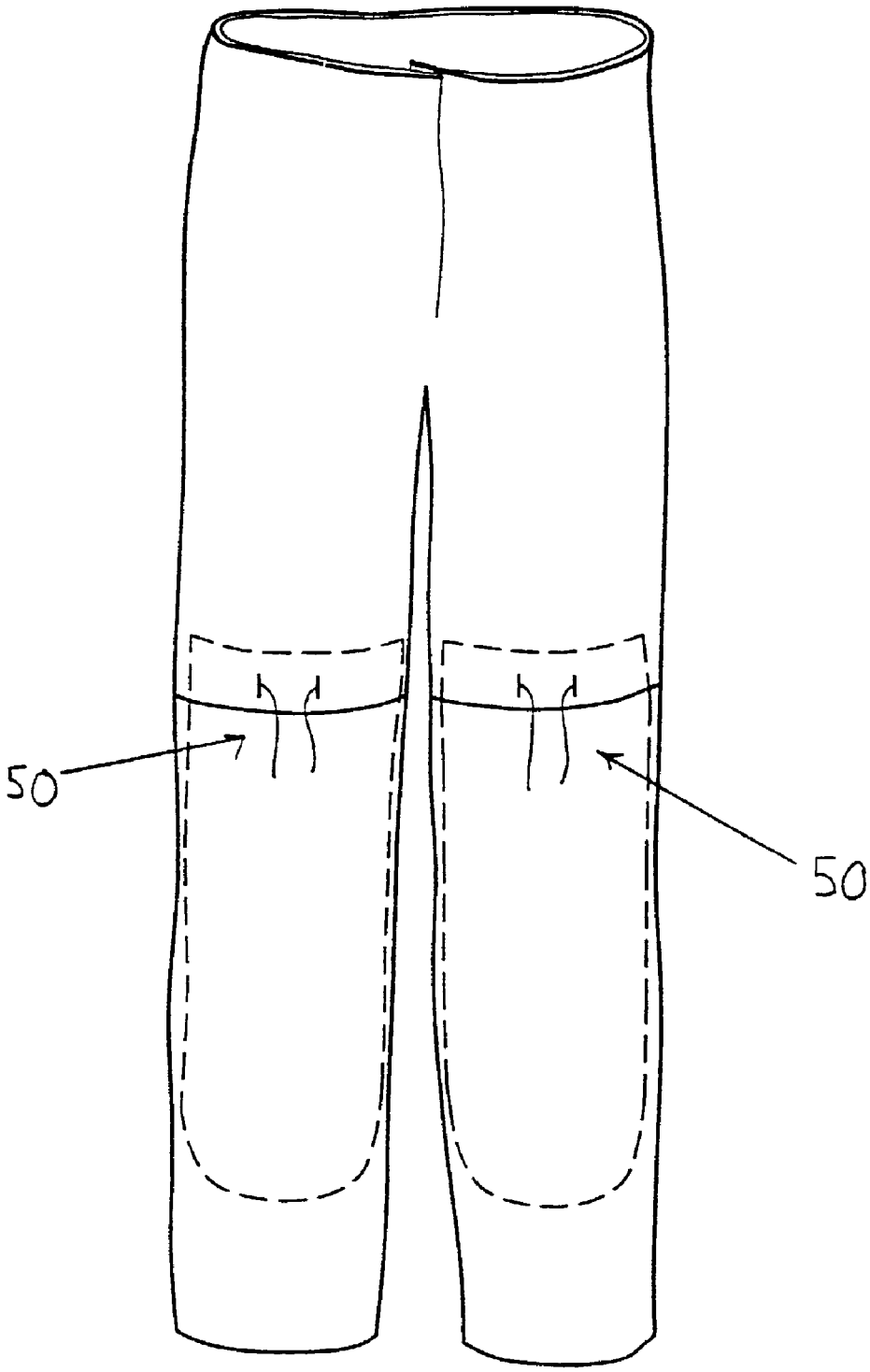
FIG. 6 is a front view of a fourth embodiment of the present invention of a pair of pants with accessible pockets.
Figure 7:
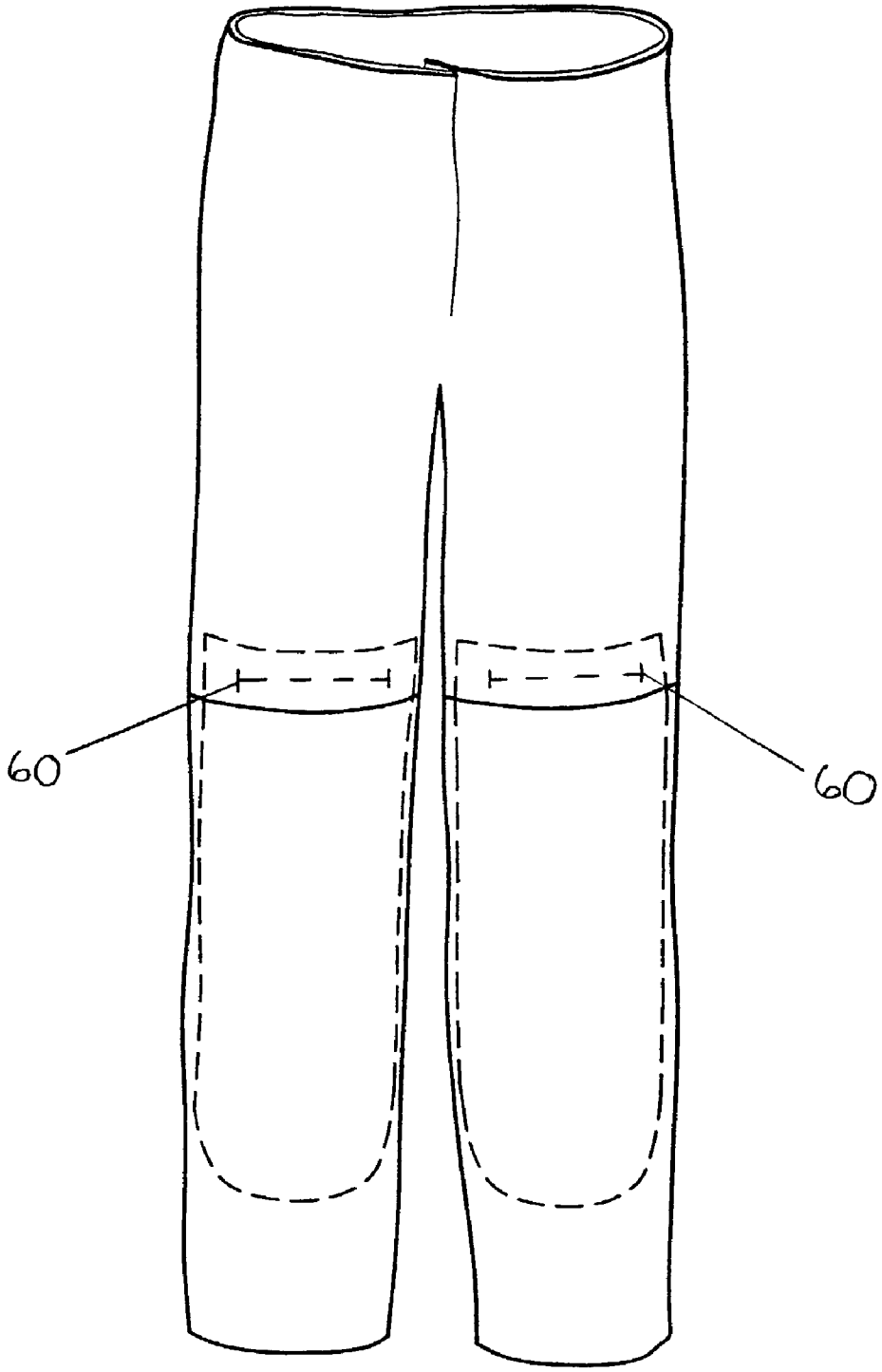
FIG. 7 is a front view of a fifth embodiment of the present invention of a pair of pants with accessible pockets.

A discrete closure may also be provided, potentially comprising one or more of the various closures previously mentioned, such as one or more threads, snaps, hooks, buttons, zippers, straps, lace, string, bungee, tie, adhesive-type material, hook and loop materials, such as Velcro®, or other like elements. A combination of closures may also be provided, such as a combination of discrete closures in combination with a closure provided by the configuration of pieces of material. As shown by FIG. 5, for example, a pair of pants consistent with the present invention can have a plurality of discrete closures (40), such as buttons or snaps, as well as a configuration of pieces of material forming a closure. FIG. 6 shows an embodiment of the invention having a closure comprising ties (50) and addition to a configuration of pieces of material forming a closure. FIG. 7 shows an embodiment of the invention having a pair of pants further comprising zippers (60) (shown in this embodiment beneath the overlap of the first and second pieces). Again, closures may be provided either independent of or in combination with the configuration of pieces of material to form a closure, and the various closures may also be provided for pockets within or outside the portion of pants, such as the pant leg, and pockets contiguous with the portion of pants such as the pant leg.

Figure 8:
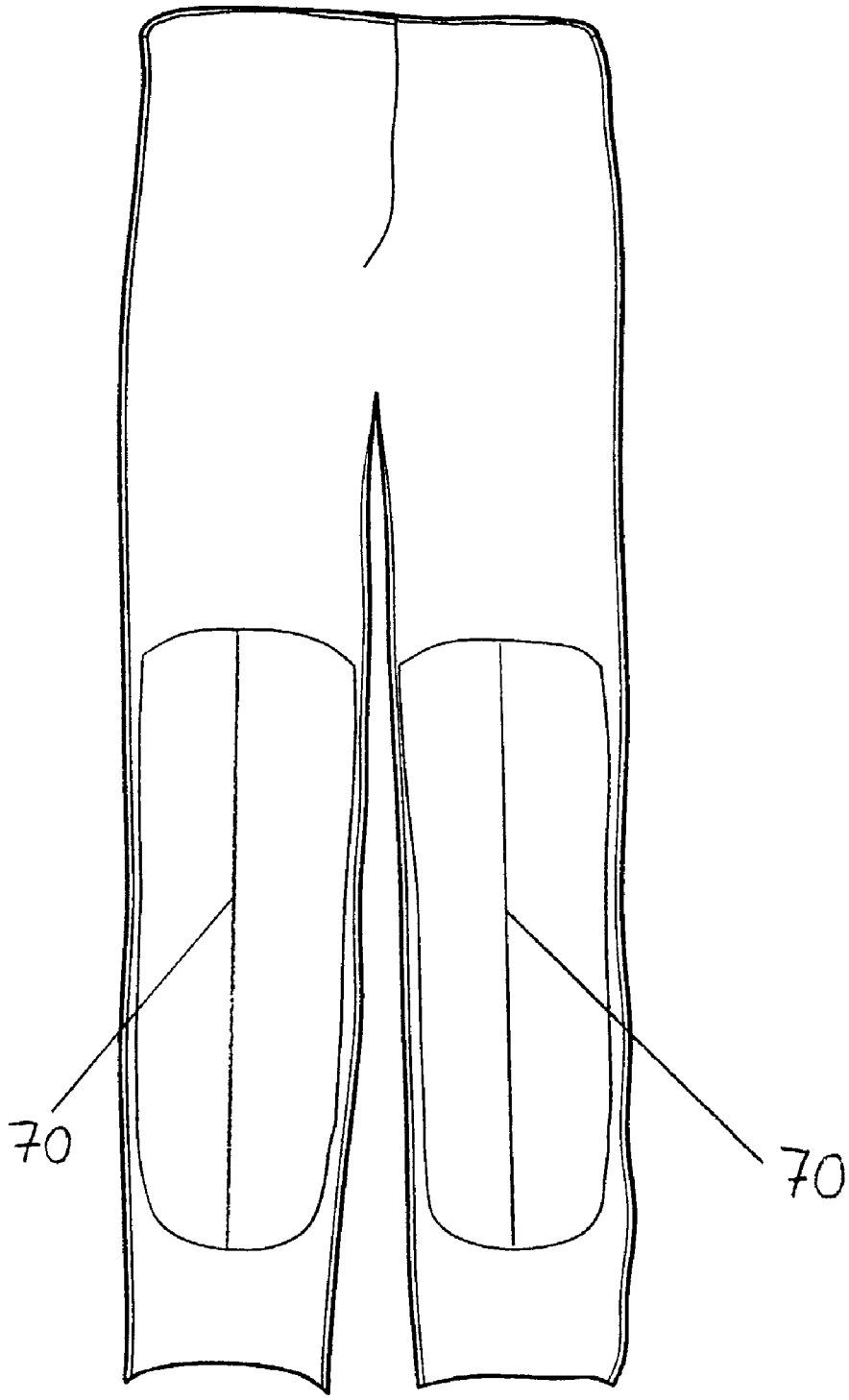
FIG. 8 is a front view of a sixth embodiment of the present invention of a pair of pants with accessible pockets.

It should be noted, however, that alternative embodiments of pairs of pants, in accordance with the present invention, may comprise different pocket configurations and different configurations of first and second materials, for example as shown variously in FIGS. 2 through 12. By way of example, a first piece of material and a second piece of material may be configured such that an access (70) is provided along a portion of the length of a pant leg, as shown in the embodiment of FIG. 8. Further, each pant leg of the front portion of the pants may comprise one or a plurality of pieces, one or all of the pieces of material configured to define the pocket or pockets.

Figure 9:
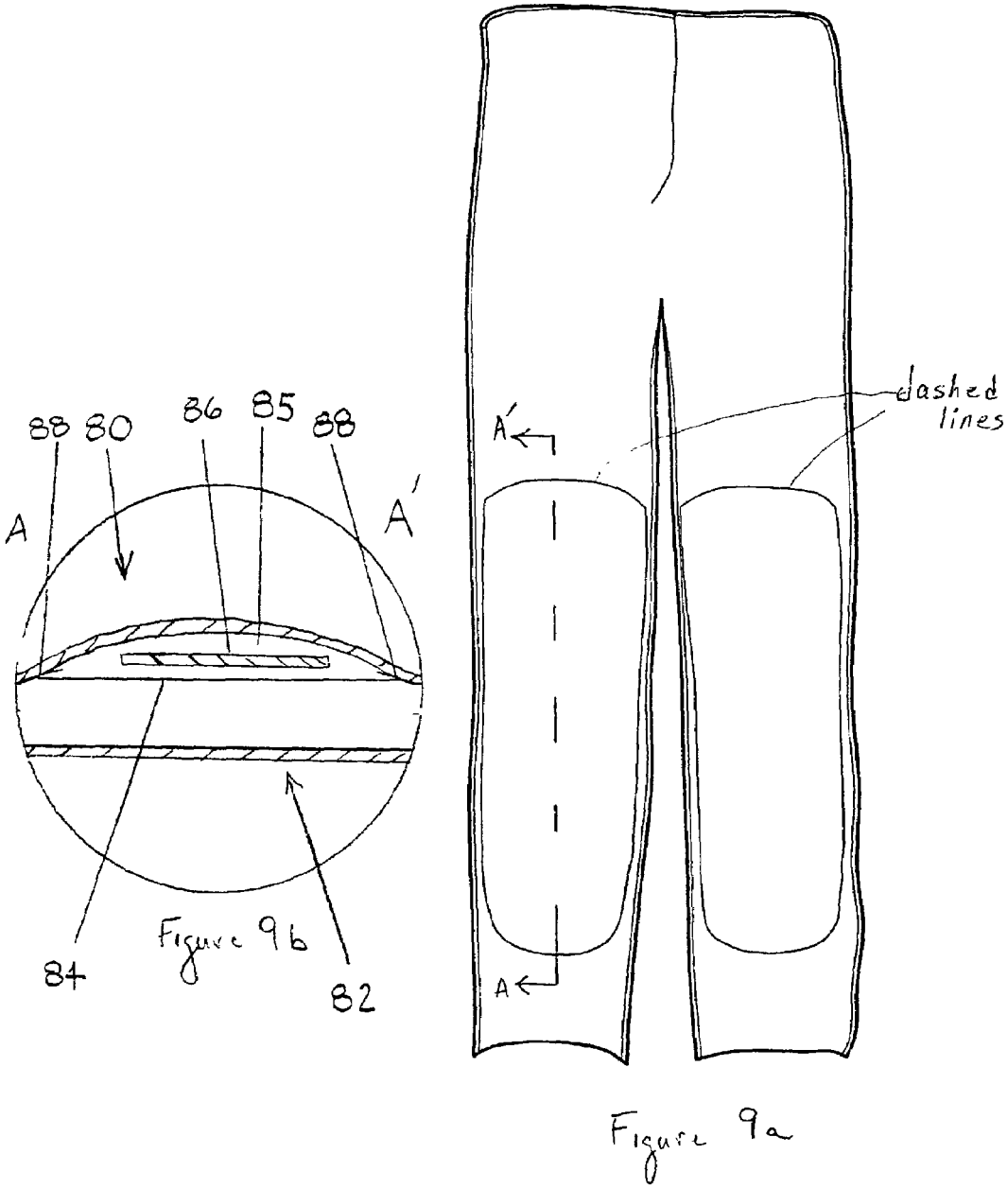
FIG. 9 are an embodiment of the present invention of a pair of pants permanently retaining a protector element.

Now referring to FIGS. 9, 10, 11, and 12 which show various constructions of pairs of pants and pockets. FIG. 9, provided as FIG. 9*a* and cross section FIG. 9*b,* shows an embodiment of a pair of pants and a pocket or pockets having no access and a pocket or pockets within an inner portion of the pant leg and as an inner feature of the pant leg. Particularly, the pants comprise, as shown in cross section 9*b, a* pocket (85) retaining the protector element (86) (further described below). Accordingly, a front portion (80) and a back portion (82) of the pair of pants are provided, the front portion and back portion being terminally joined at an inner and an outer seam in FIG. 9*a,* as previously described. In this embodiment, an elastically tensionable material (84) (further described below) is secured to the interior surface of the front portion (80) as shown as points (88), or can be co-terminally joined with the front portion and the back portion by the inner and outer seam. The securement of the material (84) can be accomplished by continuous or discrete elements, and material (84) may be fixedly or removably secured, and may be secured with one or a plurality of elements, such as one or a plurality of seams, threads, snaps, hooks, buttons, zippers, straps, lace, string, bungee, tie, adhesive-type material, hook and loop materials, such as Velcro®, or other like elements. Embodiments providing a fixedly secured material (84) to the interior surface of front portion (80) may permanently retain the protector element (86).

Although the securement of the material (84) may be fixed, such as by sewn elements, the material and the elements providing such securement, as to some embodiments, may be removed through conventional means, such as un-sewing the element. Such embodiments may still be considered fixedly secured relative to material (84), and the protector element (86) permanently retained. Permanent retainment of the protector element may be further provided for embodiments lacking an access to the pocket. Other embodiments providing elements such as Velcro® that are more easily removed may be considered removably secured relative to material (84). However, without an access to the pocket, such embodiments may still permanently retain the protector element (86), depending upon the permanency of the securement and retainment, as most previously described, and features of the material (84), as further described below.

Figures 10, 10A, 10B:
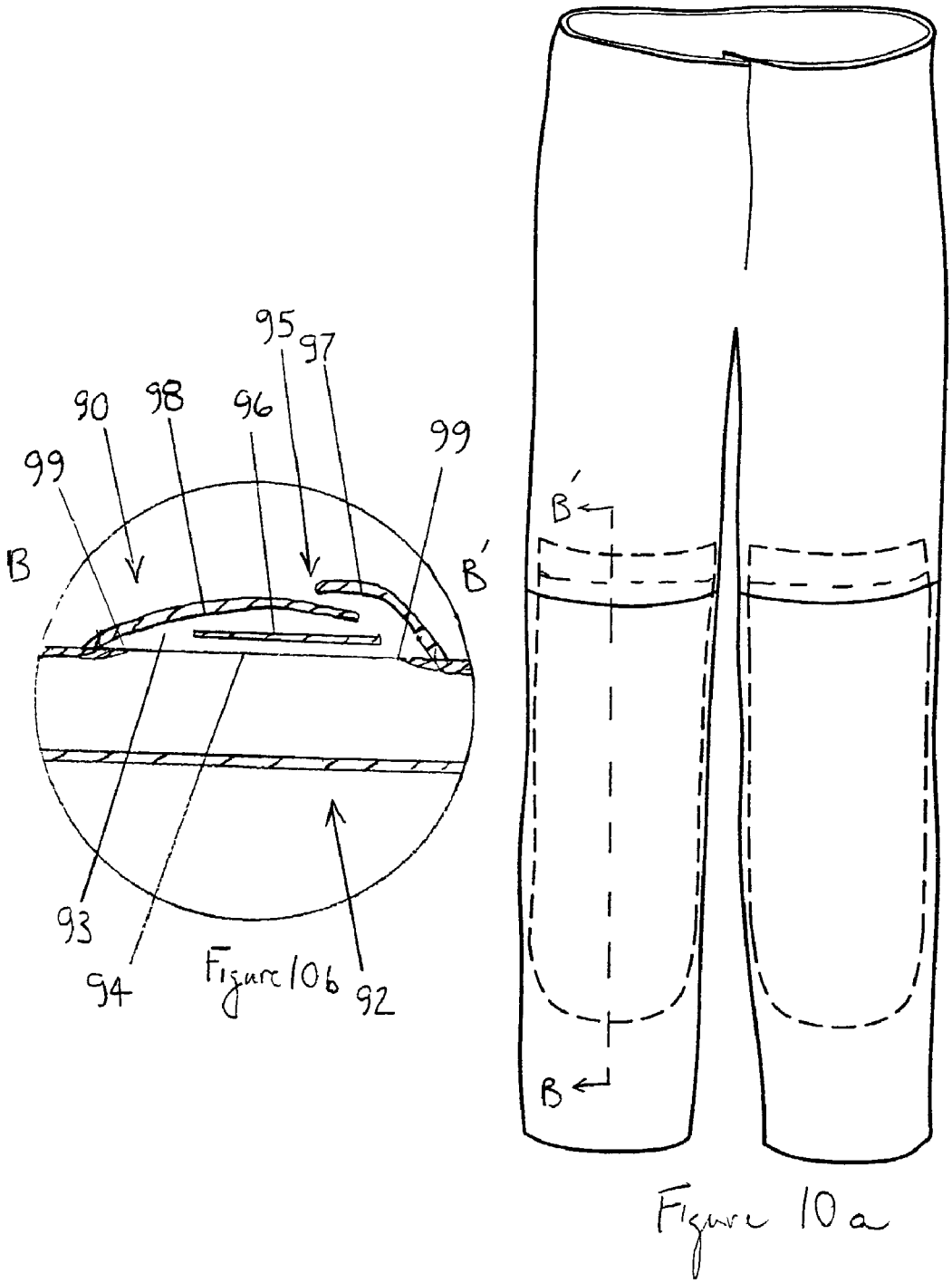
FIG. 10 are an embodiment of the present invention of a pair of pants retaining a protector element and the protector element being removably insertable.
FIG. 10*a* is a front view of the embodiment and FIG. 10*b* is a cross section at B–B'.

FIG. 10, provided as FIG. 10*a* and cross section FIG. 10*b,* show an embodiment of a pair of pants and a pocket or pockets having an access (95) and a pocket or pockets of an outer portion of the pant leg and as an outer feature of the pant leg. Particularly, the pants comprise, as shown in cross section 10*b,* a pocket (93) retaining the protector element (96) (further described below). The protector element can be configured to be removably insertable into the pocket.

Accordingly, a front portion (90) and a back portion (92) of the pair of pants are provided, the front portion and back portion being terminally joined at an inner and an outer seam in FIG. 10*a* as previously described. In this embodiment, the front portion (90) comprises a first piece of material (97) and a second piece of material (98). As previously described the first and second pieces of material may overlap, as shown in FIG. 10, providing an access (95). The access (95), in some configurations of pants and pockets, and as previously described, may provide an access from the outside to the inside of the pant leg or legs as shown in FIG. 10. Further, an elastically tensionable material (94) (further described below) is secured to an interior surface or surfaces of the front portion (90) as shown as points (99) in cross section 10*b.* The securement of the material (94) may be accomplished by continuous or discrete elements, and material (94) may be fixedly or removably secured, and may be secured with one or a plurality of elements, such as one or a plurality of seams, threads, snaps, hooks, buttons, zippers, straps, lace, string, bungee, tie, adhesive-type material, hook and loop materials, such as Velcro®, or other like elements. Embodiments providing either a removably or fixedly secured material (94) to an interior surface or surfaces of front portion (90) may removably retain the protector element (96).

Although the securement of the material (94) may be fixed, such as by sewn elements, the material and the elements providing such securement, in some embodiments, may be removed through conventional means, such as un-sewing the element. Such embodiments may still be considered fixedly secured relative to material (94). The protector element (96), however, may be removably retained, especially given access (95) configured to provide access to pocket (93) and protector element (96). Permanent retainment of the protector element may be further provided for some embodiments depending upon the permanency of the securement and retainment of the access with a closure element, as previously described, and upon features of the material (94), as further described below. Closures such as Velcro® that are more easily removed may be considered removably retaining relative to protector element (96).

Figure 11:
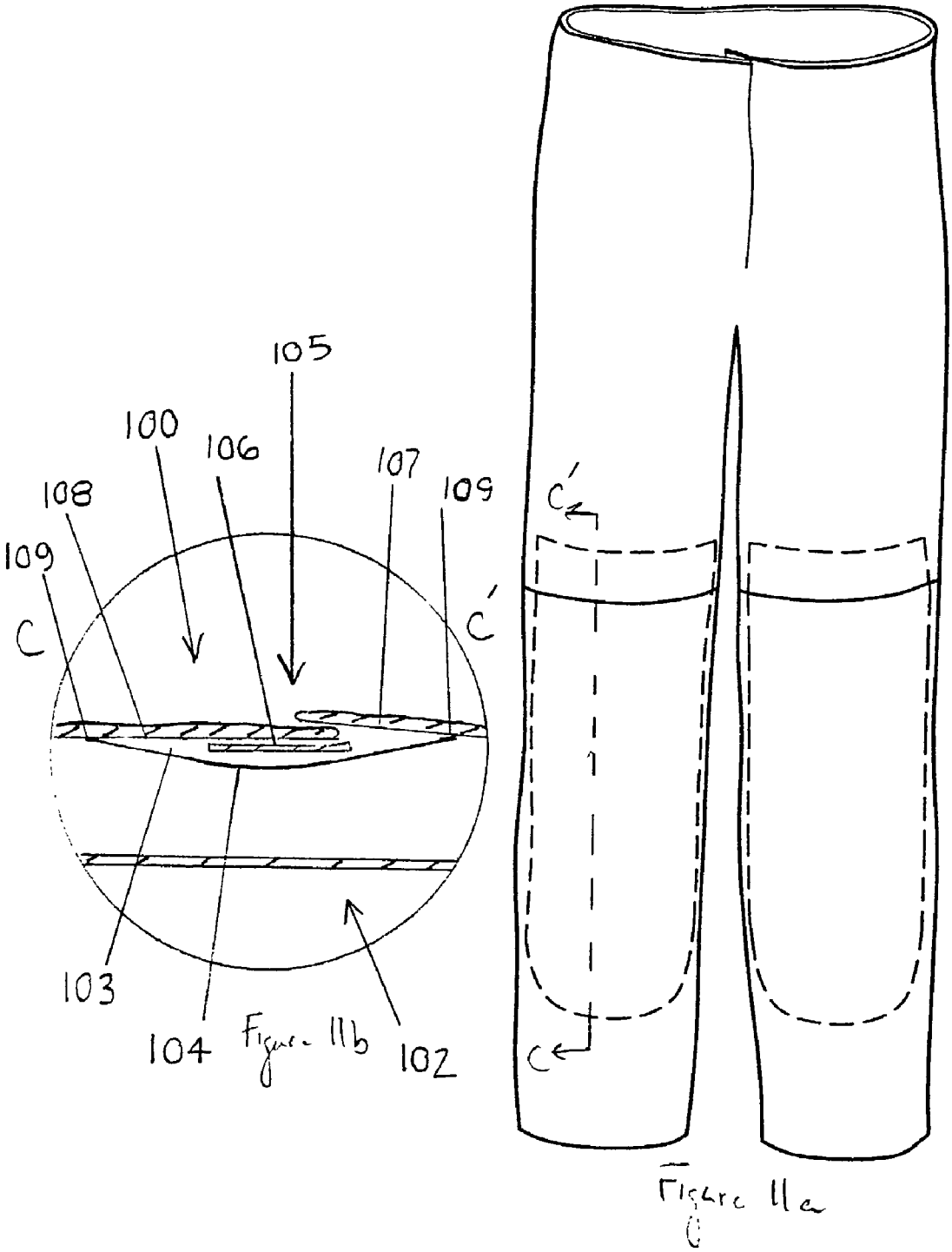
FIG. 11 are a second embodiment of the present invention of a pair of pants retaining a protector element and the protector element being removably insertable.

FIG. 11, provided as FIG. 11*a* and cross section FIG. 11*b,* show an embodiment of a pair of pants and a pocket or pockets having an access (105) and a pocket or pockets of an inner portion of the pant leg and as an inner feature of the pant leg. Particularly, the pants comprise, as shown in cross section 11*b,* a pocket (103) retaining the protector element 106 (further described below). Again, the protector element is removably insertable into the pocket.

Accordingly, a front portion (100) and a back portion (102) of the pair of pants are provided, the front portion and back portion being terminally joined at an inner and an outer seam in FIG. 11*a* as previously described. In this embodiment, the front portion (100) comprises a first piece of material (107) and a second piece of material (108). As previously described the first and second pieces of material may overlap, as shown in FIG. 11, providing an access (105). The access (105), in some configurations of pants and pockets, and as previously described, may provide an access from the outside to the inside of the pant leg or legs as shown in FIG. 11. Further, an elastically tensionable material (104) (further described below) is secured to an interior surface or surfaces of the front portion (100) as shown as points (109) in cross section 11*b.* The securement of the material (104) may be accomplished by continuous or discrete elements, and material (104) may be fixedly or removably secured, and may be secured with one or a plurality of elements, such as one or a plurality of seams, threads, snaps, hooks, buttons, zippers, straps, lace, string, bungee, tie, adhesive-type material, hook and loop materials, such as Velcro® or other like elements. Embodiments providing either a removably or fixedly secured material (104) to an interior surface or surfaces of front portion (100) may removably retain the protector element (106).

Although the securement of the material (104) may be fixed, such as by sewn elements, the material and the elements providing such securement, in some embodiments, may be removed through conventional means, such as un-sewing the element. Such embodiments may still be considered fixedly secured relative to material (104). The protector element (106), however, may be removably retained, especially given access (105) configured to provide access to pocket (103) and protector element (106). Permanent retainment of the protector element may be further provided for some embodiments depending upon the permanency of the securement and retainment of the access with a closure element, as previously described, and upon features of the material (104), as further described below. Closures such as Velcro® that are more easily removed may be considered removably retaining relative to protector element (106).

FIG. 12, provided as FIG. 12*a* and cross section FIG. 12*b*, shows an embodiment of a pair of pants and a pocket or pockets having no access outside of the pair of pants, and in this embodiment outside the pant leg, the access provided within the pant leg or legs, and a pocket or pockets within an inner portion of the pant leg and as an inner feature of the pant leg. Particularly, the pants comprise, as shown in cross section 12*b*, a pocket (113) retaining the protector element (116) (further described below). The protector element is removably insertable into the pocket.

Accordingly, a front portion (110) and a back portion (112) of the pair of pants are provided, the front portion and back portion being terminally joined at an inner and an outer seam in FIG. 12*a* as previously described. An elastically tensionable material (119), provided in the embodiment of FIG. 12 as two pieces of material (114) (115) (further described below) is secured to the interior surface of the front portion (110) as shown as points (117) in cross section 12*b*. The securement of the material (119) may be accomplished by continuous or discrete elements, and material (119) may be fixedly or removably secured, and may be secured with one or a plurality of elements, such as one or a plurality of seams, threads, snaps, hooks, buttons, zippers, straps, lace, string, bungee, tie, adhesive-type material, hook and loop materials, such as Velcro, or other like elements. Embodiments providing a fixedly secured material (119) to the interior surface of front portion (110) may permanently or removably retain the protector element 116, consistent with the provision of access (111), and as previously described in relation to other similarly configured embodiments.

Although the securement of the material (119) may be fixed, such as by sewn elements, the material and the elements providing such securement, in some embodiments, may be removed through conventional means, such as un-sewing the element. Such embodiments may still be considered fixedly secured relative to material (119), and the protector element (116) permanently retained. Permanent retainment of the protector element may be further provided for some embodiments depending upon the permanency of the securement and retainment of the access with a closure element, as previously described, and upon features of the material (119), as further described below. Closures such as Velcro® that are more easily removed may be considered removably retaining relative to protector element (113).

Relationship Between the Pocket and the Protector Element

The relationship between the pocket and the protector element, and in some preferred embodiments of the invention an elastic pocket (having the property of resisting deformation by stretching with respect to at least a portion of the pocket) or resiliently elastic pocket (having the additional property of recovering shape quickly when deforming force or pressure is removed with respect to at least a portion of the pocket) and the protector element, and with respect to some embodiments or the invention the entirety or a portion of an elastic material or resiliently elastic material and the protector element, provides a variety of additional features, aspects, or elements to the protective pants system invention along with their corresponding functional or protective advantages.

Accordingly, in various embodiments of the protective pants invention, and consistent with the numerous and varied configurations previously described including but not limited to the barrel racing rodeo pants embodiment of the invention, the pocket may be configured, whether or not the pocket is an elastic pocket or a resiliently elastic pocket to tension (stretch or the condition or degree of being stretched from which forces F can be transferred or transmitted to a protector element) or become elastically tensioned, or become resiliently elastically tensioned as shown by FIG. 13.

The pocket, the elastically tensionable pocket, or resiliently elastically tensionable pocket may correspond in location to a portion of the human body, and in preferred embodiments, correspond in location to a portion of the human leg and with respect to preferred embodiments can correspond in location to a portion of the human leg between about the ankle and knee. The portion of the human leg to which the pocket can correspond in location to can be the same portion to be protected by the protector element, a portion of the portion protected, or may correspond to a different portion from that portion of the body protected.

The material (122) from which the pocket can be constructed may be tensionable to potentially provide resilient, elastic, flexible elements, individually or in combination, in a manner that provides durability with limited memory such that resiliency, elasticity, or flexibility of the material have limited degradation with repeated use. In some embodiments of the invention, the material may comprise material such as Lycra®, Nylon Lycra®, Spandex®, Spandura®, individually, in combination, or as blends, or other resilient or elastic materials or blends thereof having substantially identical or similar resilient, elastic, or flexible characteristics, or other Spandura® like materials or blends having substantially identical or similar resilient, elastic, or flexible characteristics, individually or in combination may be used in accordance with the invention.

As to some preferred embodiments of the invention, and specifically with regard to the barrel racing rodeo pants embodiments of the invention as described (or similar applications), Spandura® or Spandura® like material can be a critical due to specific resiliency, flexibility, durability, or non-memory retaining characteristics. Particularly, Spandura™, or Spandura™ like material characteristics can be critical to pocket configurations shown in conjunction with barrel racing rodeo pants to provide the proper resilient elastic tensioning, generation of forces resulting from elastic tensioning, and the transfer of force to the protection element to generate the preferred movement of the protector element to protect the shin of the human leg during barrel racing events and the movement away from the shin of the leg during waiting intervals. The use of Spandura® or Spandura® like material can be especially critical with regard to repeated function of the barrel racing rodeo pants as described or use with an adequate product life. The statement of criticality specifically does not extend to the numerous or various other embodiments of barrel racing rodeo pants in which other configurations of pockets can be used, or where the enhanced functions, such as reduced memory, afforded by the use of Spandura® or Spandura® like material are not desired.

The protector element may be provided in the pocket, or may be insertable, or as to certain preferred embodiments removably insertable, through a corresponding access, as previously described. The protector element may be provided in various forms, consistent with the interaction of the protector element and the elastically tensionable pocket and material as disclosed in the various embodiments of the present invention. Further, the protector element should be provided in a configuration that allows movement of the protector element to a location as described in the various embodiments. Some configurations of the protector element will further be configured to conform to the portion of the human body to be protected, such as a portion of the human leg, and in some embodiments configure, conform, or move to a location corresponding to a portion of the human leg between the ankle and the knee. The location in preferred embodiments comprise a location corresponding to at least about the shin. One embodiment of the protector element may comprise a shin guard configuration. Other protector element configurations may be provided consistent with the present invention.

Again referring primarily to FIG. 13, the protector element (120) provided within the pocket (124), can be responsive to tensioning of the pocket or a portion of the pocket. Tensioning of the pocket or a portion of the pocket represented by tension T in FIG. 13*a,* in turn generates one or more forces F upon the protector element (120). Elastically tensionable material or resiliently elastically tensionable material can facilitate the generation, application, and direction of the resultant forces F to the protector element.

Again referring to FIG. 13, the forces F can be transferred from the pocket to the protector element, and in response to such transfer or transmittance of forces F, the protector element can move or travel to a different spatial location. The movement can occur with respect to one or more axis of motion relative to the protector elements location prior to applying tension to the pocket, as shown in FIG. 13*b.* With respect to the above described embodiments of the invention, the protector element can upon application of forces F move or travel within the pocket to coordinate with the movement of the human leg within pant leg to which the pocket is responsive. The location of the pocket on the pant leg, the configuration of the pocket, along with the kind, type, amount or location of elastic material or resilently elastic material can be coordinated such that as the human leg travels through the range of motion with respect to a particular activity the magnitude and direction of forces F transferred or transmitted to the protector element can be predetermined to result in a desired movement of the protector element (with respect to magnitude of distance or direction, or both) coordinated to the movement of the human leg or a portion thereof, for example between about the ankle and the knee.

As such, the magnitude of movement of the protector element with respect to distance or direction in correspondence to a particular range of motion of the human leg can be adjusted as desired. Further, the magnitude of movement of the protector element can be adjusted to account for external forces that may be transmitted to the protector element, such as forces encountered during barrel racing.

Tensioning of the elastic material or resiliently elastic material (122), or of the elastically tensionable pocket (124), may be accomplished by conforming or engaging a portion of the elastically tensionable pocket or the resiliently elastic material (122) to a portion of the human anatomy, such as, a portion of the human leg. In preferred embodiments, and as but one example, the elastically tensionable pocket has at least a portion, such as the elastically tensionable material (122), that conforms or engages to a portion of the human body, such as a portion of the human leg between about the ankle and knee. The protector element, in response to the material conforming or engaging the portion of the human leg, locates to a position corresponding to the portion of the human leg to be protected.

It should be further noted that the various embodiments of pairs of pants, pocket configurations, and other features of the invention as previously described are particularly suited for rodeo, and especially that of barrel racing. Therefore, each embodiment may be provided as rodeo pants, and in some embodiments, barrel racer rodeo pants. The pants provide features such as the pocket features and elastic tension features and elements heretofore not found in the field.

The pants also provide desirable adjustability and force absorption characteristics particularly suitable to rodeo and particularly barrel racing. Movement in response to compression or impact forces may be particularly accommodated by the various features previously described. For example, and again referring to FIG. 13, the forces F may also be generated external to the pair of pants and the pocket configurations. Forces such as compression and impaction forces, potentially created by the interaction of the horse and rider during barrel racing and an impact with a barrel, are transferred to the protector element, and in response to the forces F, the protector element moves to a location within the pocket, as shown in FIG. 13*b.*

Both in respect to barrel racing and any other competitive or work activity, graduated elastic tensioning of the pocket may be provided or generated. For example, and as previously described, the elastically tensionable material conforms to a portion of the human anatomy, particularly a portion of the leg. During movement or repositioning, or in response to an applied force, the elastically tensionable material may incrementally adjust to maintain conformance to the portion of the leg, or other portion, resulting in one or more elastic tensions of the material. The one or more elastic tensions may thus generate one or more resulting forces F upon the protector element 120. One or more elastic tensions may also result from external forces, such as impact with a barrel during barrel racing. Therefore, the elastically tensioning material may be considered incrementally elastically tensionable. In a corresponding manner, the protector element may be considered to be incrementally movable, or even incrementally adjustable.

Further, a series of movements, repositioning, or forces, can result in a gradational adjustment of the elastically tensionable material to maintain conformance to the portion of the leg, or other portion, resulting in one or more elastic tensions of the material. The one or more elastic tensions may again generate one or more resulting forces F upon the protector element. Of course, one or more tensions may also result from external forces. Therefore, the elastically tensioning material may be considered gradationally elastically tensionable. In a corresponding manner, the protector element may be considered to be gradationally movable, or even gradationally adjustable.

The incremental or gradational features of the present invention thus address the significant problems may also exist with respect to conventional protective garments in which a protector device(s) are made a part of, held by, or are inserted into the garment. The pants, pockets, and protector configurations of the present invention having incremental or gradational adjustment features allow for the wide range of activities or movement of a wearer that accompanies the transportation, handling, mounting, or riding of a horse. Because the range of activities of a barrel racer involve movement of the leg from being held substantially straight (when standing, for example) to be being bent close to the chest area (when mounting a horse, for example) along with intermediate movements during riding (which can involve intermittent standing, sitting, crouching, or rocking movements), the protective garment and apparatus, as previously mentioned, must be allowed considerable range of motion while the protector element must (during the barrel racing event) have a position corresponding portion of the wearer's anatomy to be protected. Again, specifically with respect to barrel racing which is punctuated by brief periods of competition and long waiting periods, but also with respect to other types of activities that require protection for only short periods of time and have long intervals in between, incremental and gradational features of the elastically tensionable material and the protector element allow the protective device to move to a resting or inactive location within the garment that may be more comfortable or less cumbersome to the wearer, or affords a more attractive appearance or traditional look or feel during periods of non-competition or during periods when protection is not desired.

Pant Manufacture

The pairs of pants of the present inventions may be manufactured consistent with the features of the invention. Manufacture of pairs of pants may be preferably conducted to produce the various embodiments of pants previously described.

In one embodiment of manufacture, the pair of pants are provided for manufacture. Front and back portions of the pants or pant legs may be terminally joined, as shown in the various figures, at inner and outer seams. In some embodiments a protector element may be provided. The protector element may then be retained within an elastically tensionable pocket secured to at least one pant leg, the protector element being allowed to move in response to elastic tension generated in the pocket, as previously described.

A second embodiment of manufacture may provide for the manufacture of rodeo pants, and provides a pair of pant legs, the manufacture further securing a pocket to the pants, which have a location, which corresponds to a part of the human leg between an ankle and a knee. The manufacture of the pair of pants further provide a protector element and retain the protector element within the pocket.

A third embodiment of manufacture may provide for the manufacture of barrel racer rodeo pants providing a pair of pants having a front and back portion that are terminally joined, as shown in the various figures, at inner and outer seams. The pair of pants are provided having first and second pieces of material that overlap at a location on each pant leg of the front portion of the pant to provide a corresponding access on each pant leg from the outside to the inside of the pair of pants, as previously described. A pocket having elastically tensionable material is secured to the interior surface of each pant leg of the front portion, the pocket responsive to the corresponding access. A protector element is provided removably insertable in each of the pockets through the corresponding access.

As may be shown throughout this description and the corresponding figures, other embodiments of manufacture are disclosed as would be understood from this entire disclosure.

Protection of the Human Leg

The embodiments previously described incorporate various features that provide for the protection of the human leg, particularly the leg of a barrel racer. Several methods of leg protection may be highlighted to describe some preferred features and steps for protecting the leg, especially the leg of a barrel racer.

Accordingly, the human leg may be protected by generating force, the force generated by elastically tensioning at least a portion of the pocket which retains the protector element. The force generated is transferred to the protector element and the protector element is moved to a location with the pocket in response to the force generated by elastically tensioning the portion of the pocket. The step of elastically tensioning the portion of the pocket can be accomplished as previously described. In some preferred embodiments, elastic tensioning and the generation of force may be provided by conforming the portion of the pocket, and in some embodiments the elastically tensionable material, to a portion of the human leg, such as the portion between the ankle and the knee. Further, elastic tensioning and the generation of force may be provided by mounting a horse or riding a horse. For example, embodiments of the present invention worn by an individual may generate force by elastically tensioning through the movement or positioning of the individual during the mounting and riding of a horse. Other movement or positioning may generate force by elastic tensioning consistent with the present invention.

A method of protecting the human leg may also be provided by positioning a protector element within a pocket of the present invention secured to the interior surface of a front portion of a pant leg. Force may be generated by elastically tensioning a portion of the pocket and the force transferred to the protector element positioned within the pocket, thus moving the protector element to a location within the pocket in response to the force, the locating preferably corresponding to the human anatomy of a leg between an ankle and a knee. Again, elastic tensioning and the generation of force may be provided by mounting a horse or riding a horse. For example, embodiments of the present invention worn by an individual may generate force by elastically tensioning through the movement or positioning of the individual during the mounting and riding of a horse. Other movement or positioning may generate force by elastic tensioning consistent with the present invention.

In one embodiment, the leg of a barrel racer may be protected by retaining a protector element within a pocket secured to at least one pant leg of a pair of pants of the barrel racer. The pocket is secured to the pant leg at a location corresponding to a part of a human leg between the ankle and the knee. The barrel racer mounts the horse the protector element is moved to the part of the leg between the ankle and the knee. Further, elastic tension may be generated in the pocket as previously described. Force may also be transferred to the protector element and the movement of the protector element provided in response to the transferring of force.

As may be shown throughout this description and the corresponding figures, other embodiments of leg protection methods and the protection of barrel racers are disclosed as would be understood from this entire disclosure.

As can be easily understood from the foregoing, the basic concepts of the present invention may be embodied in a variety of ways. It involves both leg protection techniques as well as devices to accomplish the protection of the human leg. In this application, the methods of leg protection are disclosed as part of the results shown to be achieved by the various apparatus and devices described and as steps which are inherent to utilization. They are simply the natural result of utilizing the devices as intended and described. In addition, while some devices are disclosed, it should be understood that these not only accomplish certain methods but also can be varied in a number of ways. Importantly, as to all of the foregoing, all of these facets should be understood to be encompassed by this disclosure.

Further, each of the various elements of the invention and claims may also be achieved in a variety of manners. This disclosure should be understood to encompass each such variation, be it a variation of an embodiment of any apparatus embodiment, a method or process embodiment, or even merely a variation of any element of these. Particularly, it should be understood that as the disclosure relates to elements of the invention, the words for each element may be expressed by equivalent apparatus terms or method terms—even if only the function or result is the same. Such equivalent, broader, or even more generic terms should be considered to be encompassed in the description of each element or action. Such terms can be substituted where desired to make explicit the implicitly broad coverage to which this invention is entitled. As but one example, it should be understood that all actions may be expressed as a means for taking that action or as an element which causes that action. Similarly, each physical element disclosed should be understood to encompass a disclosure of the action which that physical element facilitates. Regarding this last aspect, as but one example, the disclosure of an "elastically tensionable element" should be understood to encompass disclosure of the act of "elastically tensioning"—whether explicitly discussed or not—and, conversely, regarding the effective disclosure of the step of"elastically tensioning", such a disclosure should be understood to encompass disclosure of a "elastically tensionable element" and even a "means for elastically tensioning". Such changes and alternative terms are to be understood to be explicitly included in the description.

Any acts of law, statutes, regulations, or rules mentioned in this application for patent; or patents, publications, or other references mentioned in this application for patent are hereby incorporated by reference. In addition, as to each term used it should be understood that unless its utilization in this application is inconsistent with such interpretation, common dictionary definitions should be understood as incorporated for each term and all definitions, alternative terms, and synonyms such as contained in the Random House Webster's Unabridged Dictionary, second edition are hereby incorporated by reference. Finally, all references listed in the information disclosure citation filed with the application are hereby appended and hereby incorporated by reference; however, as to each of the above, to the extent that such information or statements incorporated by reference might be considered inconsistent with the patenting of the present invention, such statements are expressly not to be considered as made by the applicant(s).

Thus, the applicant(s) should be understood to claim at least: i) each of the pants as herein disclosed and described, ii) the related methods disclosed and described, iii) similar, equivalent, and even implicit variations of each of these devices and methods, iv) those alternative designs which accomplish each of the functions shown as are disclosed and described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, and ix) methods and apparatuses substantially as described hereinbefore and with reference to any of the accompanying examples, x) the various combinations and permutations of each of the elements disclosed, and xi) each potentially dependent claim or concept as a dependency on each and every one of the independent claims or concepts presented. In this regard it should be understood that for practical reasons and so as to avoid adding potentially hundreds of claims, the applicant may eventually present claims with initial dependencies only. Support should be understood to exist to the degree required under new matter laws—including but not limited to European Patent Convention Article 123(2) and United States Patent Law 35 USC 132 or other such laws—to permit the addition of any of the various dependencies or other elements presented under one independent claim or concept as dependencies or elements under any other independent claim or concept. Further, if or when used, the use of the transitional phrase "comprising" is used to maintain the "open-end" claims herein, according to traditional claim interpretation. Thus, unless the context requires otherwise, it should be understood that the term "comprise" or variations such as "comprises" or "comprising", are intended to imply the inclusion of a stated element or step or group of elements or steps but not the exclusion of any other element or step or group of elements or steps. Such terms should be interpreted in their most expansive form so as to afford the applicant the broadest coverage legally permissible.

Any claims set forth at any time are hereby incorporated by reference as part of this description of the invention, and the applicant expressly reserves the right to use all of or a portion of such incorporated content of such claims as additional description to support any of or all of the claims or any element or component thereof, and the applicant further expressly reserves the right to move any portion of or all of the incorporated content of such claims or any element or component thereof from the description into the claims or vice-versa as necessary to define the matter for which protection is sought by this application or by any subsequent continuation, division, or continuation-in-part application thereof, or to obtain any benefit of, reduction in fees pursuant to, or to comply with the patent laws, rules, or regulations of any country or treaty, and such content incorporated by reference shall survive during the entire pendency of this application including any subsequent continuation, division, or continuation-in-part application thereof or any reissue or extension thereon.

We claim:

1. A method of protecting a human leg, comprising the steps of:

a. positioning a protector element within a pocket secured to the interior surface of a front portion of a pant leg;

b. generating force by elastically tensioning a portion of said pocket having said protector element within;

c. transferring said force generated by elastically tensioning said portion of said pocket to said protector element; and d. moving said protector element from a first location within said pocket to a second location within said pocket in response to said force generated by elastically tensioning, wherein said second location corresponds to a portion of the human anatomy of a leg between an ankle and a knee.

2. A method of protecting a human leg as described in claim 1, further comprising the step of applying said portion of the human anatomy of said leg to said pocket.

3. A method of protecting a human leg as described in claim 2, further comprising the step of deforming said pocket by deforming a portion of said pocket to said portion of the human anatomy of said leg.

4. A method of protecting a human leg as described in claim 3, further comprising the step of riding a horse to deform said pocket to said portion of said human anatomy of said leg.

5. A method of protecting a human leg as described in claim 4, further comprising the step of removing said portion of the human anatomy of said leg from said pocket.

6. A method of protecting a human leg as described in claim 5, further comprising the step of reducing elastic tension in said portion of said pocket.

7. A method of protecting a human leg as described in claim 6, further comprising the step of recovering said configuration of said pocket upon reducing elastic tension in said portion of said pocket.

8. A method of protecting a human leg as described in claim 7, further comprising the step of dismounting from said horse and standing to recover said configuration of said pocket.

9. A method of protecting a human leg as described in claim 8, further comprising the step of returning said protector element to said first location in said pocket.

10. A method of manufacturing barrel racer rodeo pants comprising the steps of:

a. providing a pair of barrel racer rodeo pants having a front portion and a back portion terminally joined at an inner seam and an outer seam, wherein a first piece of material and a second piece of material overlap at a location on each pant leg of said front portion to provide a corresponding access on each said pant leg from the outside to the inside of said pair of barrel racer rodeo pants;

b. securing a pocket to the interior surface of said each pant leg of said front portion each responsive to said corresponding access, wherein at least a portion of each said pocket comprises elastically tensionable material;

c. providing a protector element removably insertable in each said pocket through said corresponding access; and d. configuring said pocket to generate sufficient elastic tension upon mounting of a horse to move said protector element from a first position in said pocket to a second position in said pocket.

11. A method of manufacturing barrel racer rodeo pants as described in claim 10, wherein said second position comprises a location corresponding to the anatomy of the human leg between about an ankle to about a knee.

12. A method of manufacturing barrel racer rodeo pants as described in claim 11, further comprising the step of providing resiliency to said elastically tensionable material sufficient to allow said pocket to recover configuration upon reducing elastic tension.

13. A method of manufacturing barrel racer rodeo pants as described in claim 12, wherein said step of providing resiliency to said elastically tensionable material sufficient to allow said pocket to recover configuration upon reducing elastic tension comprises providing Spandura® material, Lycra® material, Spandex® material, and material having substantially similar resiliently elastically tensionable characteristics to Spandura® material, material having substantially similar resiliently elastically tensionable characteristics to Lycra® material, and material having substantially similar resiliently elastically tensionable characteristics to Spandex® material.

14. A method of manufacturing barrel racer rodeo pants as described in claim 13, further comprising the step of providing operably mated securement elements to secure said first piece of material to said second piece of material.

15. Barrel racer rodeo pants, comprising:

a. a front portion and a back portion terminally joined at an inner seam and an outer seam, wherein each pant leg of said front portion comprises a first piece of material and a second piece of material that overlap to provide an access from the outside to the inside of each said pant leg;

b. a piece of elastically tensionable material terminally joined to the interior surface of said front portion to provide a pocket with said access from the outside to the inside of each pant leg; and c. a protector element removably insertable in said pocket through said access from the outside to the inside of each said pant leg, wherein said piece of elastically tensionable material has a configuration that generates sufficient forces to move said protector element from a first, resting position within said pocket to a second position within said pocket when deformed by the anatomy of a human leg.

16. Barrel racer rodeo pants as described in claim 15, wherein said second position has a location corresponding to the anatomy of a human leg between about an ankle to about a knee.

17. Barrel racer rodeo pants as described in claim 16, wherein said piece of elastically tensionable material terminally joined to the interior surface of said front portion to provide a pocket with said access from the outside to the inside of each pant leg has sufficient resiliency to recover configuration upon reduction of elastic tension.

18. Barrel racer rodeo pan as described in claim 17, wherein said piece of elastically tensionable material terminally joined at said inner seam and said outer seam.

19. Barrel racer rodeo pants as described in claim 18, wherein said piece of elastically tensionable material terminally joined at said inner seam and said outer seam is selected from the group consisting of Spandura® material, Lycra® material, Spandex® material, and material having substantially similar resiliently elastically tensionable characteristics to Spandura® material, material having substantially similar resiliently elastically tensionable characteristics to Lycra® material, and material having substantially similar resiliently elastically tensionable characteristics to Spandex® material.

20. Barrel racer rodeo pants as described in claim 19, wherein said protector element comprises a shin guard.

21. Barrel racer rodeo pants as described in claim 15 wherein said deformation of said elastically tensionable material by the anatomy of a human leg occurs upon mounting of a horse.

* * * * *